US009033717B2

(12) United States Patent
Allard et al.

(10) Patent No.: US 9,033,717 B2
(45) **Date of Patent: *May 19, 2015**

(54) ADJUSTABLE CONNECTOR SYSTEM FOR CONNECTION TO A MODULAR APPLIANCE

(71) Applicant: Whirlpool Corporation, Benton Harbor, MI (US)

(72) Inventors: Paul B. Allard, Stevensville, MI (US); Douglas D. Leclear, Benton Harbor, MI (US); Karen J. Querfurth, Coloma, MI (US); Andrew M. Tenbarge, St. Joseph, MI (US); John J. Vonderhaar, St. Joseph, MI (US); Michele Wilcox, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,051

(22) Filed: Nov. 22, 2013

(65) Prior Publication Data

US 2014/0077489 A1 Mar. 20, 2014

Related U.S. Application Data

(63) Continuation of application No. 13/732,809, filed on Jan. 2, 2013, now Pat. No. 8,591,252, which is a continuation of application No. 12/617,110, filed on Nov. 12, 2009, now Pat. No. 8,360,802.

(51) Int. Cl.

| | |
|---|---|
| ***H01R 13/44*** | (2006.01) |
| ***F25D 23/02*** | (2006.01) |
| ***F25D 23/00*** | (2006.01) |
| ***H01R 13/72*** | (2006.01) |
| *F25D 23/04* | (2006.01) |

(52) U.S. Cl.

CPC ..... *F25D 23/028* (2013.01); *F25D 23/00* (2013.01); *F25D 23/04* (2013.01); *F25D 2400/40* (2013.01); *H01R 13/72* (2013.01)

(58) Field of Classification Search

USPC ..... 439/131, 501, 502, 528; 312/223.6; 62/440, 449

See application file for complete search history.

(56) References Cited

U.S. PATENT DOCUMENTS

| | | | | |
|---|---|---|---|---|
| 1,515,505 | A | | 11/1924 | McJohn |
| 1,648,582 | A | * | 11/1927 | Dodge, Jr. ..... 191/12 R |
| 2,190,108 | A | * | 2/1940 | Crammond ..... 248/51 |
| 2,230,444 | A | | 2/1941 | Blaster |
| 2,820,112 | A | * | 1/1958 | Lupu ..... 191/12.2 R |
| 2,943,138 | A | * | 6/1960 | Reager ..... 174/66 |
| 3,030,156 | A | * | 4/1962 | Van Lunen et al. ..... 384/546 |
| 3,635,174 | A | | 1/1972 | Ball et al. |
| 3,783,175 | A | * | 1/1974 | Timmons ..... 174/500 |
| 3,883,202 | A | * | 5/1975 | Konig ..... 312/223.6 |
| 4,006,959 | A | | 2/1977 | Hopkins |

(Continued)

*Primary Examiner* — Neil Abrams

(57) ABSTRACT

An adjustable connector system for use in an appliance is provided, wherein the adjustable connector system includes a channel disposed on a surface of the appliance, an access aperture defined by a surface adjacent the channel, and a utility enabled connector at least partially received in the channel, and extending from the access aperture, wherein the utility enabled connector includes an elongated member configured to at least partially extend along the channel, and extend from the access aperture, and an interface adapted to supply at least one utility to a modular appliance configured to be removably attached to one of a plurality of removable attachment locations on the appliance.

20 Claims, 5 Drawing Sheets

(56) References Cited

U.S. PATENT DOCUMENTS

| | | | | | |
|---|---|---|---|---|---|
| 4,019,041 | A | * | 4/1977 | Prochnow | 362/3 |
| 4,372,629 | A | | 2/1983 | Propst | |
| 4,489,995 | A | | 12/1984 | Barr | |
| 4,592,602 | A | | 6/1986 | Kuster et al. | |
| 4,718,741 | A | | 1/1988 | Nichoalds | |
| 4,742,429 | A | | 5/1988 | Arrendiell et al. | |
| 4,792,881 | A | | 12/1988 | Wilson et al. | |
| 4,919,072 | A | | 4/1990 | Claassen | |
| 5,022,720 | A | | 6/1991 | Fevig | |
| 5,175,398 | A | | 12/1992 | Hofmann | |
| 5,272,988 | A | * | 12/1993 | Kelley et al. | 108/50.02 |
| 5,348,485 | A | * | 9/1994 | Briechle et al. | 439/110 |
| 5,533,797 | A | | 7/1996 | Gelber | |
| 5,607,125 | A | * | 3/1997 | Spencer | 248/51 |
| 5,679,925 | A | * | 10/1997 | Dilley | 174/53 |
| 5,765,932 | A | | 6/1998 | Domina et al. | |
| 5,877,936 | A | * | 3/1999 | Nishitani et al. | 361/600 |
| 5,923,094 | A | | 7/1999 | Seeberger et al. | |
| 5,964,617 | A | * | 10/1999 | Hoang et al. | 439/528 |
| 5,994,644 | A | | 11/1999 | Rindoks et al. | |
| 5,994,673 | A | | 11/1999 | El-Shoubary | |
| 6,113,198 | A | | 9/2000 | Hommes | |
| 6,166,722 | A | | 12/2000 | Kawabe et al. | |
| 6,205,021 | B1 | | 3/2001 | Klein et al. | |
| 6,305,388 | B1 | | 10/2001 | Zeller | |
| 6,389,968 | B1 | | 5/2002 | Sugimoto et al. | |
| 6,701,677 | B2 | * | 3/2004 | Gresham et al. | 52/36.1 |
| 6,705,890 | B2 | * | 3/2004 | Kitou et al. | 439/528 |
| 6,799,993 | B2 | | 10/2004 | Krieger et al. | |
| 6,813,896 | B1 | | 11/2004 | Janke | |
| 6,817,894 | B2 | * | 11/2004 | Sanner et al. | 439/535 |
| 6,848,369 | B1 | * | 2/2005 | King et al. | 108/50.02 |
| 6,895,868 | B1 | * | 5/2005 | Cronk et al. | 108/50.02 |
| 6,926,554 | B2 | * | 8/2005 | Liow et al. | 439/528 |
| 7,361,039 | B2 | | 4/2008 | Koehler | |
| 7,651,368 | B2 | | 1/2010 | Kendall et al. | |
| 7,654,855 | B2 | * | 2/2010 | Liao | 439/441 |
| 7,716,408 | B2 | | 5/2010 | Bhatia et al. | |
| 7,736,179 | B2 | | 6/2010 | Cook et al. | |
| 7,784,888 | B2 | | 8/2010 | Oh et al. | |
| 7,869,201 | B2 | | 1/2011 | McCoy et al. | |
| 7,870,753 | B2 | | 1/2011 | Marcy | |
| 7,887,341 | B2 | * | 2/2011 | Liao | 439/131 |
| 7,959,240 | B2 | | 6/2011 | Smith | |
| 8,033,622 | B2 | | 10/2011 | Oh et al. | |
| 8,079,867 | B2 | * | 12/2011 | Delpier et al. | 439/528 |
| 8,087,738 | B2 | | 1/2012 | Henriott | |
| 8,117,865 | B2 | | 2/2012 | Allard | |
| 8,299,656 | B2 | | 10/2012 | Allard et al. | |
| 8,382,065 | B2 | | 2/2013 | Hendrickson et al. | |
| 8,475,186 | B1 | * | 7/2013 | Sikkema et al. | 439/131 |
| 8,591,252 | B2 | * | 11/2013 | Allard et al. | 439/501 |
| 8,802,985 | B2 | * | 8/2014 | Lettkeman | 174/66 |
| 8,830,660 | B2 | * | 9/2014 | Kuehl | 361/679.01 |
| 2006/0087207 | A1 | | 4/2006 | Oh | |
| 2006/0087208 | A1 | | 4/2006 | Oh | |
| 2006/0097611 | A1 | | 5/2006 | Kim | |
| 2007/0202734 | A1 | | 8/2007 | Fugger et al. | |
| 2007/0247037 | A1 | | 10/2007 | Schenker | |
| 2008/0165282 | A1 | | 7/2008 | Marcy | |
| 2013/0056259 | A1 | | 3/2013 | Lettkeman | |

* cited by examiner

ADJUSTABLE CONNECTOR SYSTEM FOR CONNECTION TO A MODULAR APPLIANCE

CROSS-REFERENCE TO RELATED APPLICATION

This application is a continuation of U.S. patent application Ser. No. 13/732,809, now U.S. Pat. No. 8,591,252, filed on Jan. 2, 2013, entitled ADJUSTABLE CONNECTOR SYSTEM FOR CONNECTION TO A MODULAR APPLIANCE, which is a continuation of U.S. patent application Ser. No. 12/617,110, now U.S. Pat. No. 8,360,802, filed on Nov. 12, 2009, entitled ADJUSTABLE CONNECTOR SYSTEM FOR CONNECTION TO A MODULAR APPLIANCE, the entire disclosures of which are hereby incorporated by reference.

FIELD OF THE INVENTION

The present invention generally relates to a connector system for use in an appliance, and more particularly, an adjustable connector system that supplies at least one utility to a modular appliance that removably attaches to an appliance.

BACKGROUND OF THE INVENTION

Generally, refrigerators are available in many styles, but the most common styles include both a refrigerator compartment and a freezer compartment, which may be side-by-side or one on top of the other. Often, refrigerator features such as ice making, ice crushing, water dispensing, precise temperature and/or humidity control, vacuum packaging, thawing, and fast chilling are available. All of these features typically require some type of utility, such as water, chilled air, or mechanical power to provide the benefit.

Newer concepts in refrigeration have included modular units which fit within a refrigerated compartment in order to provide the advantageous features above. Such modules are themselves a great convenience for the users of the refrigerators so equipped.

SUMMARY OF THE INVENTION

According to one aspect of the present invention, an adjustable connector system for use in an appliance is provided, and includes a channel disposed on a surface of the appliance, an access aperture defined by a surface adjacent the channel, and a utility enabled connector at least partially received in the channel, and extending from the access aperture. The utility enabled connector includes an elongated member configured to at least partially extend along the channel, and extend from the access aperture, and an interface adapted to supply at least one utility to a modular appliance configured to be removably attached to one of a plurality of removable attachment locations on the appliance.

According to another aspect of the present invention, an adjustable connector system for use in a door of an appliance is provided, and includes a substantially vertical channel disposed on an interior surface of the appliance door, an access aperture defined by a surface adjacent the substantially vertical channel, a storage area adjacent the access aperture, and a utility enabled connector at least partially received in the substantially vertical channel, and extending from the access aperture to be in an interior of the appliance. The utility enabled connector includes an elongated member configured to at least partially extend along the substantially vertical channel, and extend from the access aperture, wherein the elongated member is configured to be manually retracted into the storage area through the access aperture, and an interface adapted to supply at least one utility to a modular appliance configured to be removably attached to one of a plurality of removable attachment locations on the appliance door.

Yet another aspect of the present invention is an adjustable connector system for use in a door of an appliance. The adjustable connector system includes a substantially vertical channel disposed on an interior surface of the appliance door, an access aperture defined by a surface adjacent the substantially vertical channel, a storage area adjacent the access aperture, a utility enabled connector at least partially received in the substantially vertical channel, and extending from the access aperture to be interior to the appliance. The utility enabled connector includes an elongated member configured to at least partially extend along the substantially vertical channel, and extend from the access aperture to be in an interior of the appliance, and an interface adapted to supply at least one utility to a modular appliance configured to be removably attached to one of a plurality of removable attachment locations on the appliance door, and a spring loaded cam in operable communication with the elongated member, wherein the spring loaded cam is configured to retract the utility enabled connector through the access aperture to the storage area.

These and other aspects, objects, and features of the present invention will be understood and appreciated by those skilled in the art upon studying the following specification, claims, and appended drawings.

DETAILED DESCRIPTION

Figure 1:
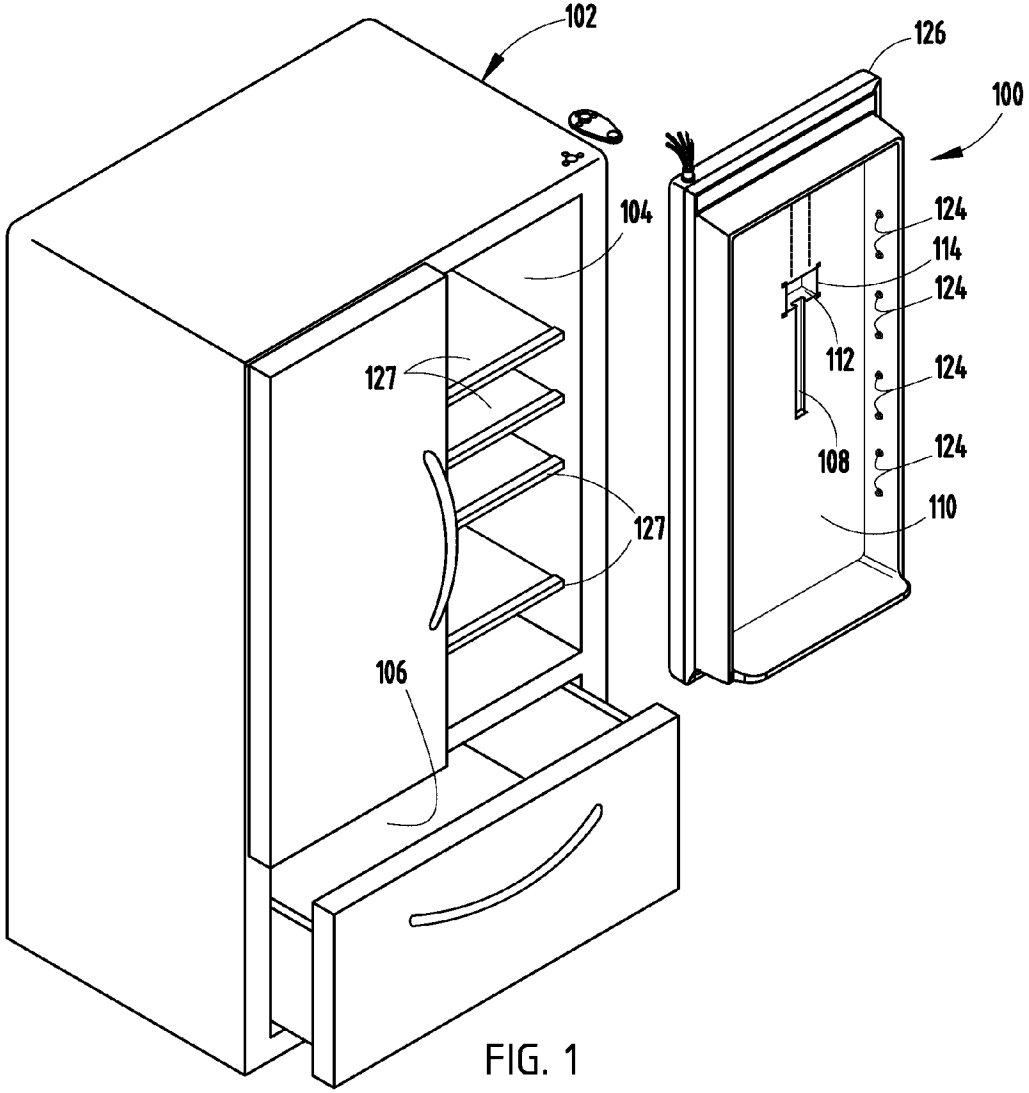
FIG. 1 is a perspective view of an appliance including an adjustable connector system, in accordance with one embodiment of the present invention.

For purposes of description herein, the terms "upper," "lower," "right," "left," "rear," "front," "vertical," "horizontal," and derivatives thereof shall relate to an adjustable connector system for connection to a modular appliance. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With respect to FIGS. 1-6, an adjustable connector system is generally shown at reference identifier 100. The adjustable connector system 100 can be used in an appliance, generally indicated at reference identifier 102, such as, but not limited to, a refrigerator. In such an embodiment, the appliance 102 can include a refrigerator section 104 (FIGS. 1 and 4), a freezer section 106 (FIGS. 1 and 4), or a combination thereof. It should be appreciated by those skilled in the art that the description contained herein as to the appliance 102 being a refrigerator is for exemplary purposes, and not for purposes of limitation, such that the appliance 102 can be other suitable appliances.

The adjustable connector system 100 can include a channel 108 disposed on a surface 110 of the appliance 102, and an access aperture 112 defined by a surface 114 adjacent the channel 108. The adjustable connector system 100 can further include a utility enabled connector, generally indicated at reference identifier 116, which is at least partially received in the channel 108, and extending from the access aperture 112. The utility enabled connector 116 can include an elongated member 118 configured to extend along at least a portion of the channel 108, and extend from the access aperture 112, and one or more interfaces 120 adapted to supply at least one utility to a modular appliance 122 configured to be removably attached to one of a plurality of removable attachment locations 124 on the appliance 102, as described in greater detail herein.

By way of explanation and not limitation, the adjustable connector system 100 can be utilized in the appliance 102, such that the position of the utility enabled connector 116 can be altered, and the utility enabled connector 116 can be connected to the modular appliance 122 without regard as to which removable attachment location 124 of the modular appliance 122 is currently located. According to one exemplary embodiment, in operation, consumers of varying heights (e.g., consumers of different heights, handicap consumers in a wheelchair, and etc.) can alter the height of the modular appliance 122 to be located at different removable attachment locations 124 to accommodate their height. The utility enabled connector 116 can then be adjusted to connect to the modular appliance 122, so that the modular appliance 122 can perform the desired function. Additionally or alternatively, the modular appliance 122 can be removably attached at different removable attachment locations 124 due to accommodating one or more other items being stored in the appliance 102.

According to one embodiment, at least a portion of the channel 108 on the surface 110 of the appliance 102 approximately aligns with the plurality of removable attachment locations 124 on the appliance 102. Additionally or alternatively, the channel 108 can be either substantially horizontal (FIG. 4) or substantially vertical (FIGS. 1-3, 5, and 6). However, it should be appreciated by those skilled in the art that the channel 108 can extend in other linear and non-linear directions, such as, but not limited to, diagonally, a curve or "S" shape, the like, or a combination thereof. It should further be appreciated by those skilled in the art that the description herein with respect to FIGS. 1-3, 5, and 6, which illustrate the channel 108 substantially vertical, can be applicable to an embodiment, wherein the channel 108 extends in a different direction (e.g., FIG. 4), has a different shape, or a combination thereof.

The utility enabled connector 116 can extend from the access aperture 112 to be one of either exterior or interior of the appliance 102. For purposes of explanation and not limitation, the adjustable connector system 100 is described herein as being located so that the utility enabled connector 116 extends from the access aperture 112 to be in an interior of the appliance 102, and more specifically, the utility enabled connector 116 can be extending from an interior surface 114 of a door 126 of the appliance 102 (FIGS. 2-5). Thus, an interior of the appliance 102 can be an interior space defined my one or more surface, and such surfaces, including an interior surface of a door of the appliance 102. Additionally or alternatively, the adjustable connector system 100 can be utilized in other interior spaces of the appliance 102, such as, but not limited to, being used in conjunction with one or more shelving units 127 so as to allow for horizontal removable attachment locations 124 on the appliance 102. In yet another exemplary embodiment, the adjustable connector system 100 can be positioned so that the utility enabled connector 116 extends from the access aperture 112 to be exterior of the appliance 102, such that the removable attachment locations 124 on an exterior of the appliance 102 allow the modular appliance 122 to be removably attached to an exterior of the appliance 102. It should be appreciated by those skilled in the art that the appliance 102 can include a plurality of adjustable connector systems 100 (FIG. 6), such that a plurality of utility enabled connectors 116 are on an interior of the appliance 102, an exterior of the appliance 102, or a combination thereof.

The access aperture 112 can be located at approximately one end of the channel 108, which can align with one end of a plurality of removable attachment locations 124. Alternatively, the access aperture 112 can be located in an intermediate position of the channel 108, such that a portion of the channel 108 extends one direction from the access aperture 112, and the channel 108 extends in another direction from the access aperture 112. In such an embodiment, wherein the access aperture 112 can be located in an intermediate position of the channel 108, the portions of the channel 108 typically extend from the access aperture 112 at approximately one hundred eighty degrees (180°) from one another. Additionally or alternatively, in an embodiment having the access aperture 112 be in an intermediate position, the portions of the channel 108 extend from the access aperture 112 in a spatial relationship other than approximately one hundred eighty degrees (180°).

The adjustable connector system 100 can include a storage area 128 adjacent the access aperture 112. According to one embodiment, at least a portion of the elongated member 118 of the utility enabled connector 116 can be configured to be manually retracted into the storage area 128 through the access aperture 112. According to an alternate embodiment, the adjustable connector system 100 includes a cam 130 (FIG. 2A) in operable communication with the elongated member 118 of the utility enabled connector 116, wherein the cam 130 is configured to retract at least a portion of the elongated member 118 of the utility enabled connector 116 through the access aperture 112 to the storage area 128. The cam 130 can be, but is not limited to, a spring loaded cam.

Whether the elongated member 118 is manually retracted into the storage area 128 or retracted into the storage area 128 by the cam 130, the access aperture 112 and the storage area 128 can be configured to receive the interface 120 of the utility enabled connector 116. In such an embodiment, if there are no modular appliances 122 removably attached to the removable attachment locations 124 or if there are non-used one or more interfaces 120 or utility enabled connectors 116, the non-used interfaces 120 can be stored in the storage area 128. Further, when the elongated member 118 and interface 120 of the utility enabled connector 116 is contained in the storage area 128, a cover 131 can be removably attached to the surface 114 to cover at least a portion of the access aperture 112.

Figure 3B:
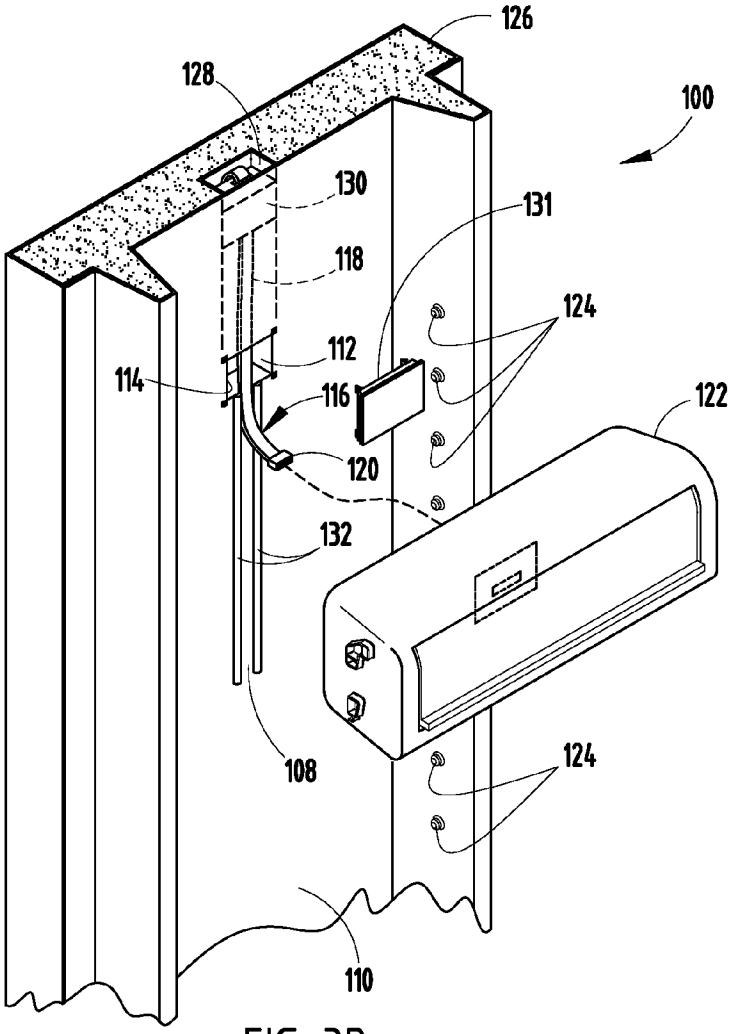
FIG. 3B is a partial cross-sectional, exploded perspective view of an adjustable connector system utilized in a refrigerator door, in accordance with one embodiment of the present invention.
Figure 3A:
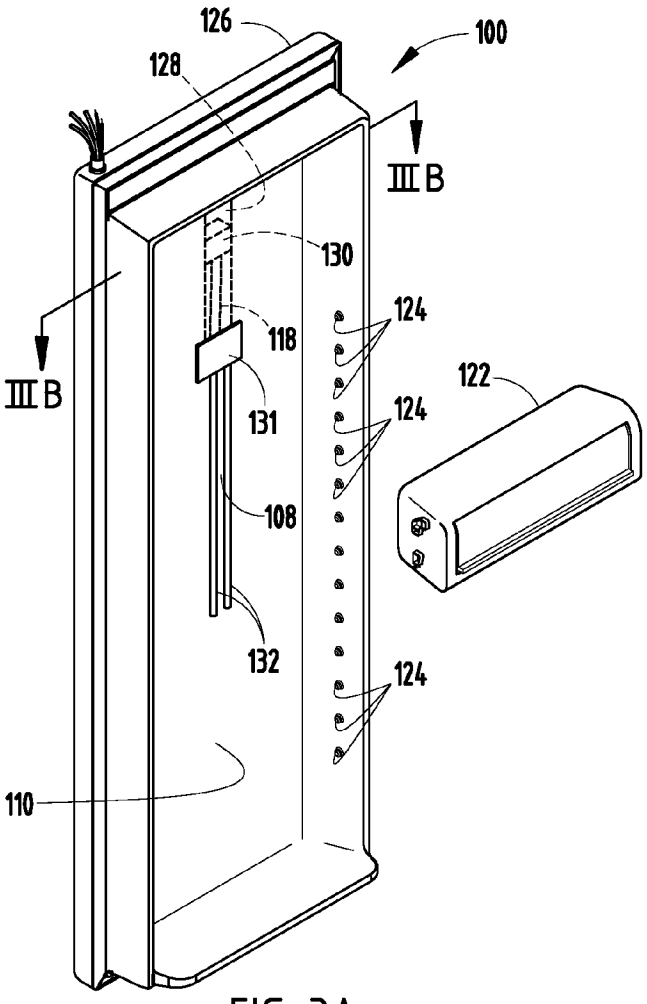
FIG. 3A is a partially exploded perspective view of an adjustable connector system utilized in a refrigerator door, in accordance with one embodiment of the present invention.
Figure 4:
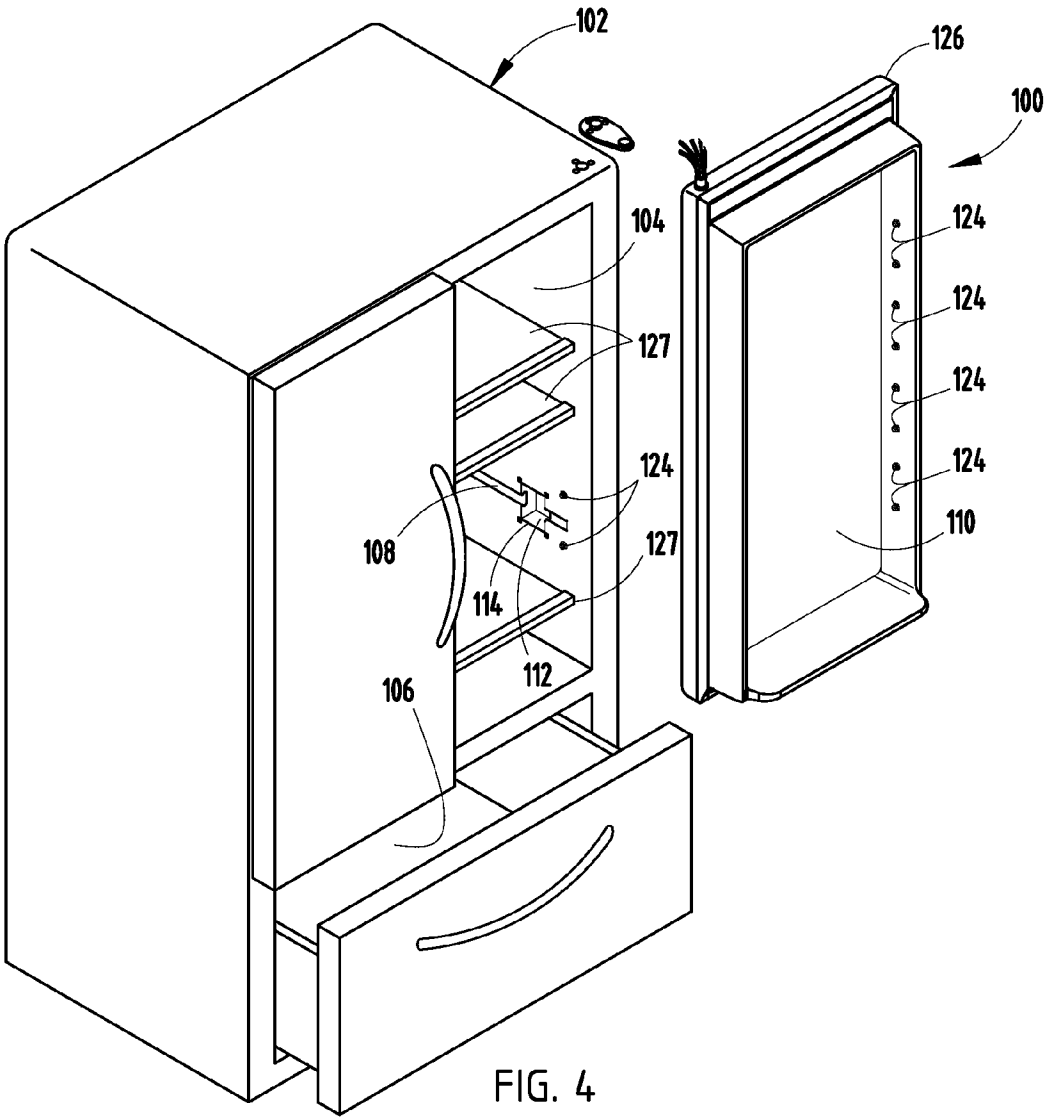
FIG. 4 is a perspective view of an appliance including an adjustable connector system, in accordance with one embodiment of the present invention.
Figure 6:
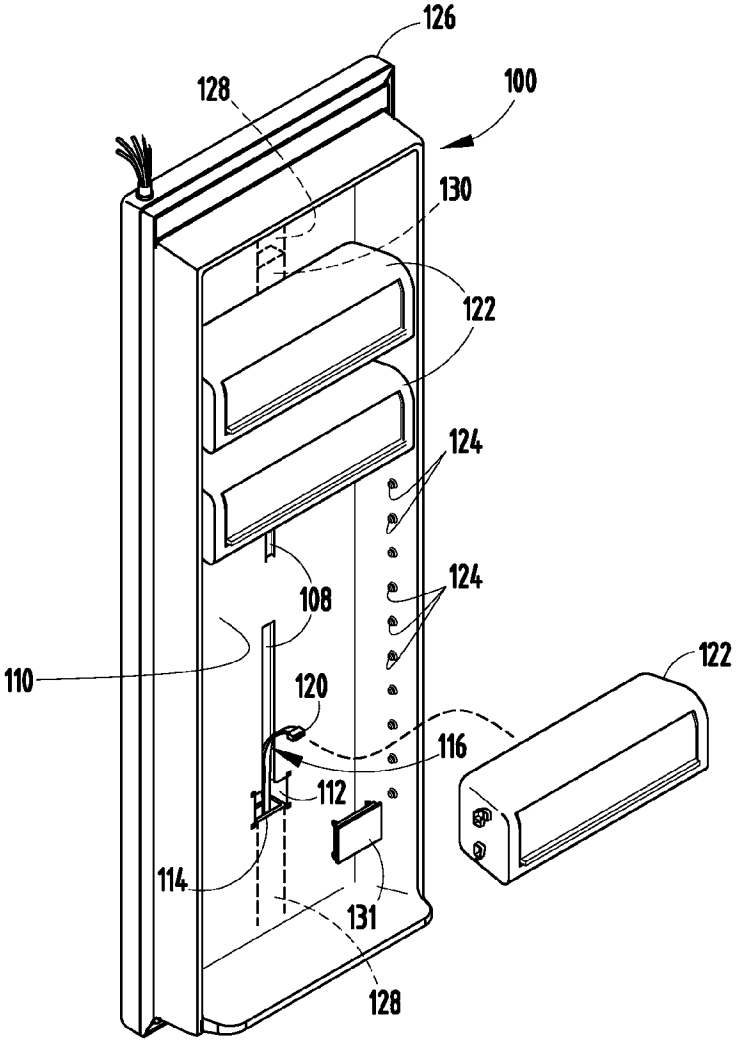
FIG. 6 is a partial cross-sectional, exploded perspective view of a plurality of adjustable connector systems utilized in a refrigerator door, in accordance with one embodiment of the present invention.
Figure 5:
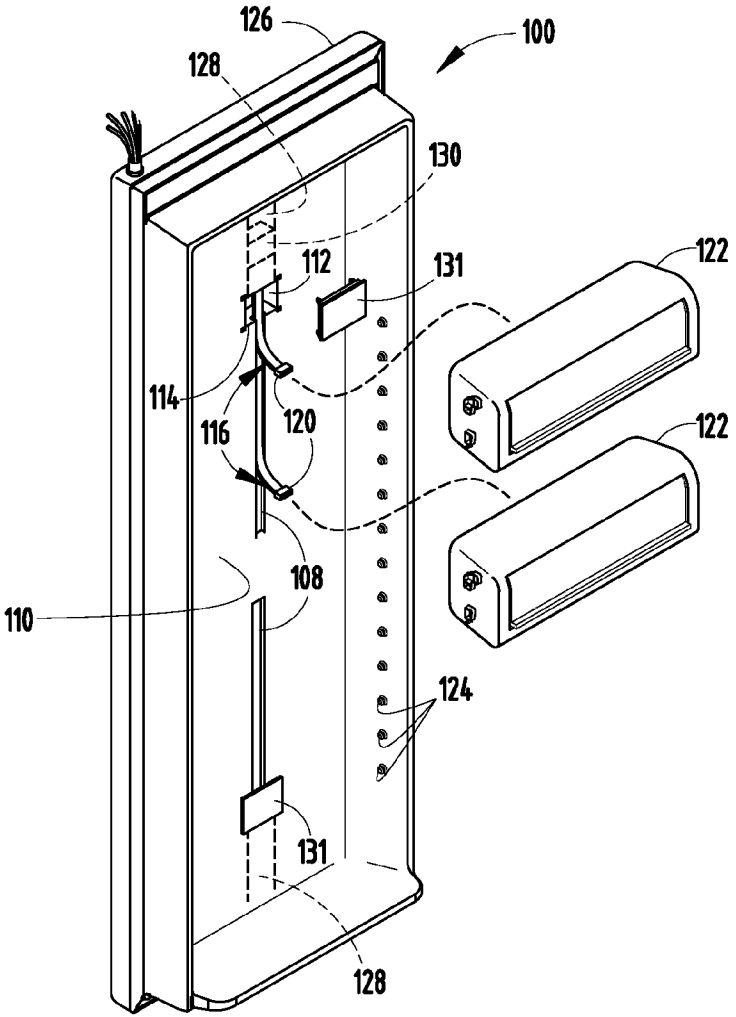
FIG. 5 is a partial cross-sectional, exploded perspective view of an adjustable connector system utilized in a refrigerator door, in accordance with one embodiment of the present invention.

The adjustable connector system 100 can include at least one attachment member 132, according to one embodiment (FIGS. 3A and 3B). Typically at least a portion of the channel 108 is substantially flush with the surface 110 of the appliance 102, and the attachment member 132 is adapted to removably grasp the elongated member 118 of the utility enabled connector 116. For purposes of explanation and not limitation, if the modular appliance 122 is located at one removable attachment location 124 spaced from the access aperture 112, a portion of the elongated member 118 extending from the access aperture 112 to the interface 120 connecting to the modular appliance 122 can be placed into the channel 108 and adequately removably grasped by the attachment member 132 to limit movement of the elongated member 118 during typical operation of the appliance 102. Such removable grasping of the elongated member 118 by the attachment member 132 can have improved aesthetics, such that the free movement of the elongated member 118 can be limited during typical operation of the appliance 102, as compared to an embodiment, wherein the elongated member 118 is not removably grasped by the attachment member 132 to limit such free movement.

Figure 2B:
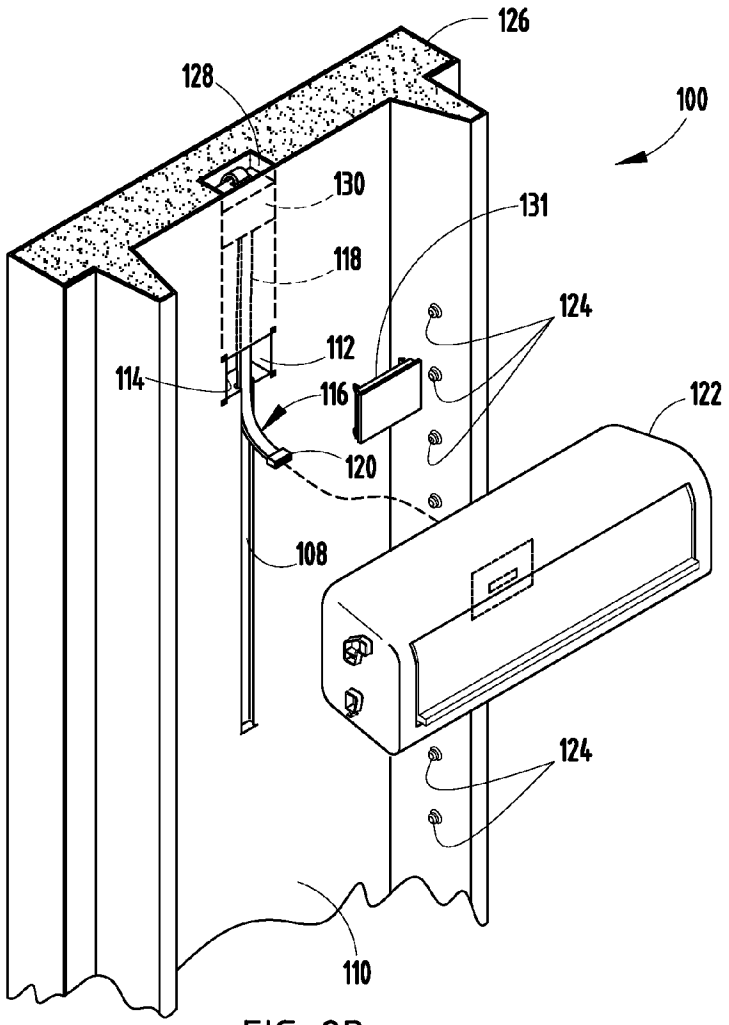
FIG. 2B is a partial cross-sectional, exploded perspective view of an adjustable connector system utilized in a refrigerator door, in accordance with one embodiment of the present invention.
Figure 2A:
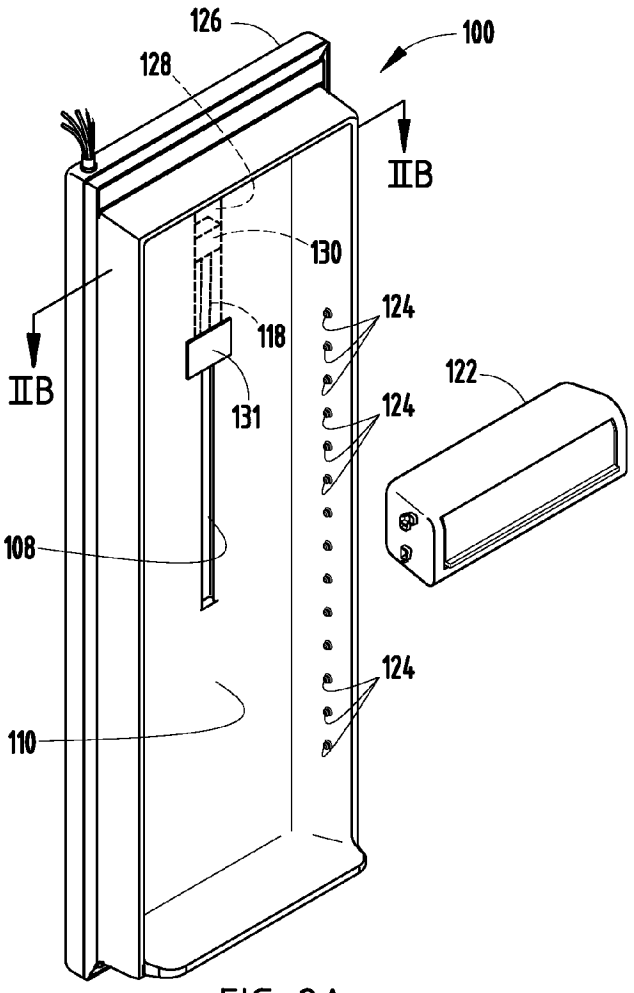
FIG. 2A is a partially exploded perspective view of an adjustable connector system utilized in a refrigerator door, in accordance with one embodiment of the present invention.

Additionally or alternatively, the adjustable connector system 100 can include at least a portion of the channel 108 being defined by a depression in the surface 110 of the appliance 102 (FIGS. 2A and 2B). Typically, at least a portion of the depression can be configured to removably grasp the elongated member 118 of the utility enabled connector 116. For purposes of explanation and not limitation, if the modular appliance 122 is located at a removable attachment location 124 spaced from the access aperture 112, the portion of the elongated member 118 extending from the access aperture 112 to the interface 120 that is connected to the modular appliance 122 can be placed in the depression to adequately removably grasp the elongated member 118 and limit movement of the elongated member 118 during typical operation of the appliance 102. Such removable grasping of the elongated member 118 during typical operation of the appliance 102 can have improved aesthetics, such that free movement of the elongated member 118 can be limited during operation of the appliance 102, as compared to an embodiment, wherein the elongated member 118 is not removably grasped by the depression to limit such free movement.

According to one embodiment, the adjustable connector system 100 can include the storage area 128 adjacent the access aperture 112, wherein the storage area 128 is configured to store at least a portion of the utility enabled connector 116. The adjustable connector system 100 can further include the surface 110 being a liner that overlays at least a portion of the storage area 128. Thus, the excess portion of the utility enabled connector 116 that is contained in the storage area 128 is covered by the liner, and a user of the appliance 102 does not see this excess portion of the utility enabled connector 116.

The utility enabled connector 116 can be adapted to supply electrical power, a gas, a fluid, data, the like, or a combination thereof, according to one embodiment. Typically, the interface 120 is adapted to make such connections without requiring multiple interfaces, such that the interface 120 can be detachably connected to the modular appliance 122, and supply one or more utilities through the interface 120. The end of the elongated member 118 not connected to the interface 120 can be connected to one or more components of the 102, such as, but not limited to, an electrical power source, a gas source, a fluid source, a memory device, a controller, a processor, the like, or a combination thereof, and the elongated member 118 can pass through an infrastructure of the appliance 102. Exemplary interfaces for allowing these types of connections are disclosed in U.S. patent application Ser. No. 12/539,651, now U.S. Pat. No. 8,299,656, entitled "PARK PLACE REFRIGERATION MODULE UTILITIES ENABLED VIA CONNECTION," and U.S. Patent Application Publication No. 2009/0229298, now U.S. Pat. No. 8,117,865, entitled "REFRIGERATOR WITH MODULE RECEIVING CONDUITS," wherein these references are hereby incorporated herein by reference in their entirety. In one exemplary embodiment, the interface 120 can be a quick connect fitting.

According to one embodiment, the adjustable connector system 100 can include a plurality of utility enabled connectors 116 and a plurality of channels 108 (FIG. 6), each of the plurality of channels 108 configured to at least partially receive at least one of the plurality of utility enabled connectors 116 extending from the access aperture 112. Additionally or alternatively, the plurality of utility enabled connectors 116 can extend from multiple access apertures 112, such that the appliance 102 includes a plurality of adjustable connector systems 100.

Additionally or alternatively, the appliance 102 can include a plurality of adjustable connector systems 100, wherein at least a portion of the plurality of adjustable connector systems 100 can each include separate components (e.g., separate channels 108, access apertures 112, and utility enabled connectors 116), can be integrally connected (e.g., share one or more components, such as, but not limited to, a channel 108, an access aperture 112, a utility enabled connector 116, or a combination thereof).

Advantageously, the adjustable connector system 100 allows for a modular appliance 122 to be removably attached to various locations 124, while being connected to the utility enabled connector 116. Thus, the readjustment of the utility enabled connector 116 to extend to different removable attachment locations 124 and connecting to the modular appliance 122 allows for flexibility in the location of the modular appliance 122 within the appliance 102, while maintaining an ability of the modular appliance 122 to perform one or more desired functions. It should be appreciated by those skilled in the art that there may be additional or alternative advantages of the adjustable connector system 100. It should further be appreciated by those skilled in the art that the above-described elements of the adjustable connector system 100 can be utilized in additional or alternative combinations.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An adjustable connector system for use in an appliance, the adjustable connector system comprising:

a channel disposed on an interior surface of an appliance;

an access aperture defined by a surface adjacent the channel; and a utility enabled connector configured to supply at least fluid from the appliance to at least one modular appliance and wherein the utility enabled connector is at least partially received in the channel and, wherein the utility enabled connector comprises:

an elongated member configured to at least partially extend along the channel, and extend from the access aperture; and an interface adapted to supply at least fluid to the at least one modular appliance wherein the interface is configured to be removably attached to one of a plurality of removable attachment locations on the appliance.

2. The adjustable connector system of claim 1, wherein at least a portion of the channel on the surface of the appliance approximately aligns with the plurality of removable attachment locations on the appliance and wherein the utility enabled connector extends from the access aperture.

3. The adjustable connector system of claim 2, wherein the interface is a quick connect fitting.

4. The adjustable connector system of claim 1, wherein the channel is one of either substantially horizontal or substantially vertical and wherein the interface is a quick connect fitting.

5. The adjustable connector system of claim 1 further comprising a storage area adjacent the access aperture, wherein at least a portion of the elongated member of the utility enabled connector is configured to be manually retracted into the storage area through the access aperture.

6. The adjustable connector system of claim 1 further comprising a storage area adjacent the access aperture, and a cam in operable communication with the elongated member of the utility enabled connector, wherein the cam is configured to retract at least a portion of the elongated member of the utility enabled connector through the access aperture to the storage area.

7. The adjustable connector system of claim 6, wherein the cam is a spring loaded cam and wherein the system further comprises at least one attachment member, wherein at least a portion of the channel is substantially flush with the surface of the appliance, and the at least one attachment member is adapted to removably grasp the elongated member of the utility enabled connector.

8. The adjustable connector system of claim 1, wherein at least a portion of the channel is defined by a depression in the surface of the appliance.

9. The adjustable connector system of claim 8, wherein at least a portion of the depression is configured to removably grasp the elongated member of the utility enabled connector.

10. The adjustable connector system of claim 1 further comprising a storage area adjacent the access aperture, wherein the storage area is configured to store at least a portion of the utility enabled connector, and a liner that overlays at least a portion of the storage area.

11. The adjustable connector system of claim 1, wherein the utility enabled connector is adapted to supply fluid and at least one other utility from the appliance wherein the at least one other utility is chosen from the group consisting of: a gas; electrical power; and data.

12. The adjustable connector system of claim 1, wherein the utility enabled connector comprises a plurality of utility enabled connectors, and the channel comprises a plurality of channels, each of the plurality of channels configured to at least partially receive at least one of the plurality of utility enabled connectors extending from the access aperture.

13. An adjustable connector system for use in a door of an appliance, the adjustable connector system comprising:

a channel disposed on an interior surface of the appliance door;

an access aperture defined by a surface adjacent the substantially vertical channel;

a storage area adjacent the access aperture; and a utility enabled connector at least partially received in the channel, and extending from the access aperture to be within an interior of the appliance, wherein the utility enabled connector comprises:

an elongated member configured to at least partially extend along the channel, and extend from the access aperture, wherein the elongated member is configured to be retracted into the storage area through the access aperture; and an interface adapted to supply at least fluid to a modular appliance configured to be removably attached to one of a plurality of removable attachment locations on the appliance door.

14. The adjustable connector system of claim 13, wherein at least a portion of the channel is substantially flush with the surface of the appliance door, and wherein the system further comprises at least one attachment member adapted to removably grasp the elongated member of the utility enabled connector and wherein the channel is a liner channel and the interface is a quick connect fitting.

15. The adjustable connector system of claim 13, wherein at least a portion of the channel is defined by a depression in the surface of the appliance door, and at least a portion of the depression is configured to removably grasp the elongated member of the utility enabled connector and wherein the channel is a liner channel and the interface is a quick connect fitting.

16. The adjustable connector system of claim 13, wherein the utility enabled connector is adapted to supply fluid and at least one other utility from the appliance wherein the at least one other utility is chosen from the group consisting of: a gas; electrical power; and data.

17. An adjustable connector system for use in a door of an appliance, the adjustable connector system comprising:

a plurality of channels disposed on an interior surface of the appliance door;

at least one access aperture defined by a surface adjacent at least one of the channels;

at least one storage area adjacent the at least one access aperture;

at least one utility enabled connector at least partially received in each of the channels, and extending from an access aperture to be within an interior of the appliance, wherein each utility enabled connector comprises:

an elongated member configured to at least partially extend along one of the plurality of channels, and extend from at least one access aperture; and an interface adapted to supply at least fluid to a modular appliance configured to be removably attached to one of a plurality of removable attachment locations on the interior surface of the appliance door; and a cam in operable communication with the elongated member, wherein the cam is configured to retract the utility enabled connector through the access aperture to the at least one storage area.

18. The adjustable connector system of claim 17, wherein the channels are substantially vertical and wherein at least a portion of the channels are substantially flush with the surface of the appliance door, and wherein the system further comprises at least one attachment member adapted to removably grasp the elongated member of the utility enabled connector.

19. The adjustable connector system of claim 17, wherein the channels are substantially vertical and wherein at least a portion of the channels are defined by a depression in the surface of the appliance door, and at least a portion of the depression is configured to removably grasp the elongated members of the utility enabled connectors.

20. The adjustable connector system of claim 17, wherein the utility enabled connectors are quick connect fittings that are adapted to supply fluid and at least one other utility chosen from the group consisting of a gas; electrical power; and data.

* * * * *